US006067668A

United States Patent [19]

Rudd

[11] Patent Number: 6,067,668

[45] Date of Patent: May 30, 2000

[54] BELLOWS PUMP FOR CLEARING CLOGGED TOILETS AND DRAINS

[76] Inventor: Merlin Elton Rudd, 9552 Castine Dr., Huntington Beach, Calif. 92646-8461

[21] Appl. No.: 09/168,532

[22] Filed: Oct. 8, 1998

[51] Int. Cl.[7] ..... E03D 11/00

[52] U.S. Cl. ..... 4/255.11; 4/255.01

[58] Field of Search ..... 4/255.11, 255.01; 417/472; 92/34; D32/35; D8/14

[56] References Cited

U.S. PATENT DOCUMENTS

| | | | |
|---|---|---|---|
| 2,844,826 | 7/1958 | Cheiten | 4/255.11 |
| 4,539,985 | 9/1985 | Magrath | 417/472 X |
| 4,745,641 | 5/1988 | Tash | 4/255.11 |

*Primary Examiner*—Henry J. Recla
*Assistant Examiner*—Kathleen J. Prunner

[57] ABSTRACT

The present invention relates to a bellows pump for clearing clogged toilets and drains having a cylindrical bellows with handle, preferably releasable, connected to a cylindrical tube, with an adapter having a central aperture throughout. Preferably the cylindrical tube has annual joints to provide flexibility and the adapter is conical shaped, elongated, resilient, and flexible for improved sealing. The device is generally made of rubber or plastic. Preferably the transverse pleats of the bellows decrease in diameter from the top of the bellows to the bottom of the bellows for easier collapsibility. A handle on the top of the bellows permanently attached thereto, allows the bellows to be easily collapsed causing a rush of air or water from the device. The device is reasonably light, durable and can be used in a variety of applications.

9 Claims, 2 Drawing Sheets

BELLOWS PUMP FOR CLEARING CLOGGED TOILETS AND DRAINS

BACKGROUND—FIELD OF INVENTION

This invention relates to "Plumbers helpers", specifically to those devices used to clear clogged toilets and drains.

BACKGROUND—DESCRIPTION OF PRIOR ART

This invention relates to "plumbers helpers" or drain clearing devices, plungers and other manual devices used to clear stopped-up drains and, in particular, toilets. The most popular devices on the market today to clear stopped-up toilets are plungers. They come in a variety of shapes and sizes but they all operate on the same principle of covering the drain hole or outlet, and manually forcing the plunger handle in a downward motion into a resilient collapsible cap that, when collapsed and released, creates a blast of air and suction into the drain or outlet to unclog the blockage.

For many years the majority of toilets that were manufactured had the drain outlet located in the bottom center of the bowl, easily accessible to the plunger style of device.

With the advent of the low water volume (1.6 gallon) toilets, the manufacturers were required to redesign their toilets to function with a reduced amount of water for each flush. In many instances this resulted in a change of size, shape and location of the drain outlet in the toilet bowl. Many of the newer style toilets are now designed with the drain outlet located in the rear side of the toilet bowl rather than in the center of the bottom of the bowl as on the older style toilets. In addition, many of the drain outlets on he newer toilets are smaller in diameter and many are placed at the rear of a channel that may be rounded or angular, requiring a different type and shape of device to reach the drain outlet and provide an adequate seal to allow the device to function properly. This change makes many of the "plumbers helpers" devices on the market today unusable in the newer low volume toilets.

U.S. Pat. No. D364,251 to Novak, Alan Nov. 14, 1995 and U.S. Pat. No. D385,073 to Tash, George Oct. 14, 1997 are typical of the plunger style "plumbers helpers" that, because of their inherent design, will not function as designed in many of the newer low water volume toilets. The shape and size of their base sealing member, whether it be an inverted cup shaped device or a bellows shaped device, is too large and not capable of reaching and providing the seal necessary to operate in many of the newer style low water volume toilets especially those with a smaller diameter drain outlet located at the rear side of the bowl or at the end of a channel.

Another problem is created when a toilet stops up and the bowl is full of water. Using the plunger type "plumbers helpers" in many instances causes the toilet water to overflow or splash out onto the floor. U.S. Pat. No. 4,922,555 to Bonilla, Marco A. and Bonilla, Linda M. May 8, 1990 and U.S. Pat. No. 5,099,527 to Roose, Lars D. Mar. 31, 1992 are for splash deflectors to be used with plunger style "plumbers helpers" to prevent this occurrence.

There have been several U.S. Patents issued to bellows and plunger/pump type "plumbers helpers" that differ in operation from the plunger type device, including U.S. Pat. No. 3,994,032 to Spickofsky, William Paul Nov. 30, 1976 and U.S. Pat. No. 4,733,414 to Wilkes, Karl A. Mar. 29, 1988, U.S. Pat. No. 4,542,543 to Irwin, Lawrence F. Sep. 24, 1985, U.S. Pat. No. 3,934,280 to Tancredi, Pier Luigi Jan. 27, 1976, U.S. Pat. No. 4,566,139 to Jeng, Chi-Cheng Jan. 28, 1986, and U.S. Pat. No. 5,522,094 to Balazs, Louis F. Jun. 14, 1996.

All of these devices function by an internal plunger or bellows type operation that, when a handle is depressed, collapses a bellows or moves a sealing plunger down a cylindrical tube forcing air out of the device into an outlet or drain opening to open a blockage. All of these devices are functional on toilet drain outlets that are located in the bottom center of the toilet bowl but would have difficulty or, in most cases, would not be able to reach and/or provide an adequate seal in the smaller diameter rear channel outlets of the newer style toilets.

The problem lies with the sealing portion on many of the current devices. They make a seal by placing the device over the top of the drain outlet. Downward pressure placed on the device to operate it provides the required seal.

Additionally, the older style toilets had a relatively standard size drain outlet which allowed the "plumbers helpers" to work on the majority of toilets using the over the drain outlet sealing approach. Some devices worked by inserting their sealing portion into the drain outlet, but the majority of these devices are designed to fit the larger diameter old style toilet drain outlet located in the center bottom of the toilet bowl and again would not operate as designed in the newer style toilets.

OBJECTS AND ADVANTAGES

Several objects and advantages of my invention are to produce a device for unclogging toilets and drains that is practical, light weight, easy to understand and use, as well as being of a simple mechanical design that is easy to manufacture, particularly through the Blow Mold process.

Another object is to produce a device that is reasonably inexpensive to purchase, and most importantly will work and function in a variety of different designs and styles of toilets and drains. In this invention a bellows that is designed to remain above the toilet bowl and out of the water provides a blast of air or water when collapsed through a cylindrical tube and conical shaped adapter into a toilet or drain outlet to unclog a blockage. Having the bellows above the toilet bowl eliminates the movement and splashing of water normally associated with a drain clearing device used under water.

The use of a bellows to create the air flow provides the user with a greater variety of pressures and air volume by allowing the user to regulate the amount and speed of collapsing the bellows. The bellows handle can be lifted upwards increasing the volume of air in the bellows and then by regulating the speed used in collapsing the bellows provide either a quick single blast of air through the device or a constant pressure release.

A cylindrical tube with annular joints provides the flexibility that allows the device to reach both the bottom center and the rear/side located toilet drain outlets that are used in many of the newer low water volume (1.6 gal.) toilets.

The elongated resilient and flexible conical shaped adapter allows the device to be inserted into toilet or drain outlets and completes an adequate seal in a variety of shapes and sizes of drain outlets, particularly those on the newer style low water volume toilets. The cap or top portion of the conical shaped adapter allows pressure to be exerted against the adapter without the adapter collapsing on itself. The length of the conical shaped adapter allows it to make an effective seal in a variety of diameters of drain outlets. Its resiliency and flexibility allow the conical shaped adapter to fit and provide a seal in a variety of shapes and sizes of drain openings but return to its original shape when it is removed from said opening.

Still further objects and advantages will become apparent from a consideration of the ensuing description and accompanying drawings.

Figure 1:
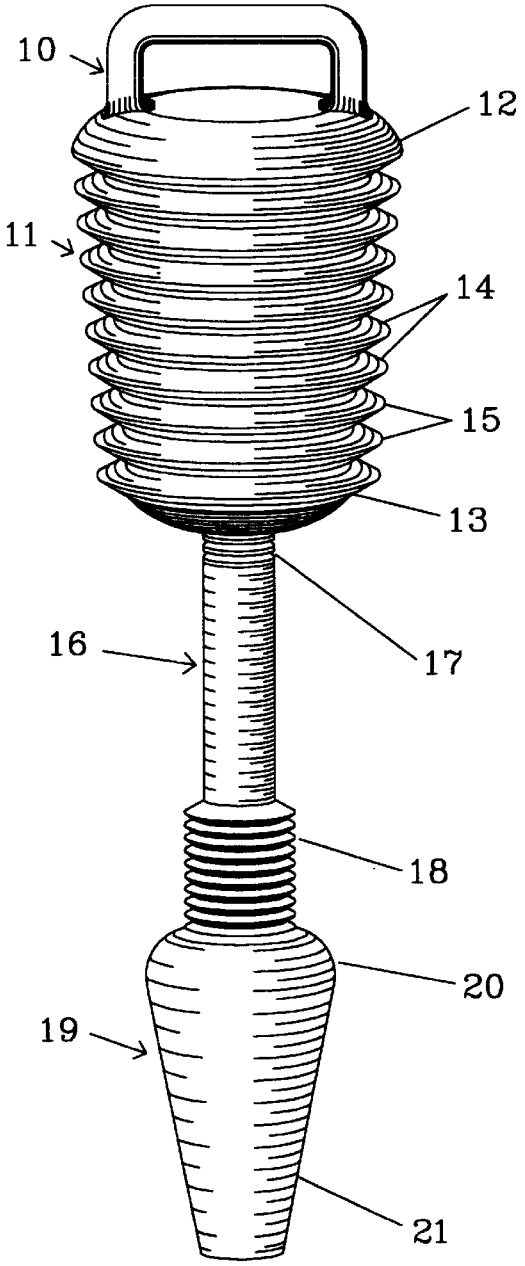
FIG. 1 is a schematic side elevation of the Bellows Pump for Clearing Clogged Toilets and Drains, shown in the relaxed uncompressed state showing all parts of the device.

| Reference Numerals |
|---|
| 10 handle |
| 11 bellows |
| 12 top of the bellows |
| 13 bottom of the bellows |
| 14 transverse pleats |
| 15 angular outer peripheries |
| 16 cylindrical tube |
| 17 threads on the cylindrical tube |
| 18 pleated annular joints |
| 19 elongated conical shaped adapter |
| 20 top cap |
| 21 cone portion |
| 22 outlet tip of the adapter |

SUMMARY

An object of this invention was to obtain a device for unclogging toilets and drains that was practical, simple to understand and use, highly efficient and durable and economical to purchase. Another object was a device having a simple mechanical design that is easy to manufacture, particularly through the process of Blow Molding, and most importantly a device which will function in a variety of different types and styles of toilets and drains.

A cylindrical tube with flexible annular joints allows the device to reach both the center/bottom and rear/side located toilet drain outlets. The elongated resilient and flexible conical shaped adapter allows the device to be inserted into the toilet or drain opening and complete an adequate seal in a variety of shapes and sizes of drain outlets, particularly those in the newer low volume toilets.

Preferred Embodiment—Description—FIGS. 1 to 4

DETAILED DESCRIPTION

This invention relates to a Bellows Pump for clearing clogged toilets and drains which can be made of rubber or plastic, but preferably plastic, using the Blow Mold process. It can be produced easily and economically. Further, the present invention has effectively functioned to release clogged drains in a variety of toilets.

Now, referring to FIG. 1 of the drawings, the Bellows Pump for clearing clogged toilets and drains is schematically depicted herein. The handle 10 is unitary with the bellows 11. The bellows 11 is generally cylindrical and hollow. The bellows 11 includes a plurality of transverse pleats 14 that decrease in diameter from the top of the bellows 12 to the bottom 13 of the bellows 11 proportionally. The bellows 11 reduces in diameter to allow for ease of compression. The bellows pleats 14 have angular outer peripheries 15 and are aligned transversely to the bellows. The wall thickness of the pleats can be essentially uniform or slightly less at the pleat intersections. The resiliency of the bellows allows the bellows to return to their relaxed open state after being compressed. The bellows 11 is attached to a cylindrical tube 16 by the use of threads 17 on the cylindrical tube 16.

The cylindrical tube 16 has pleated annular joints 18 to provide some flexibility but yet retain its overall rigidity during compression of the bellows. The cylindrical tube 16 provides added length to the device allowing the bellows to operate above the toilet bowl. The elongated conical shaped adapter 19 with a top cap 20 which is harder and denser, prevents the cylindrical tube from collapsing into the adapter. The elongation and conical shape allows the cone portion 21, which is resilient and flexible, to reach and conform to a variety of shapes and sizes of toilet and drain outlets. The flexible adapter cone 21 provides a wear resistant sealing ring within the toilet or drain outlet and its resiliency allows the adapter to return to its original shape when removed from the drain outlet.

The device in total has a central aperture extending from the top of the bellows 12 through the outlet tip of the adapter 19. Downward pressure on the handle 10 causes the bellows 11 to collapse, and air to be forced from the bellows through the cylindrical tube and out the tip of the elongated conical shaped adapter.

Figure 2:
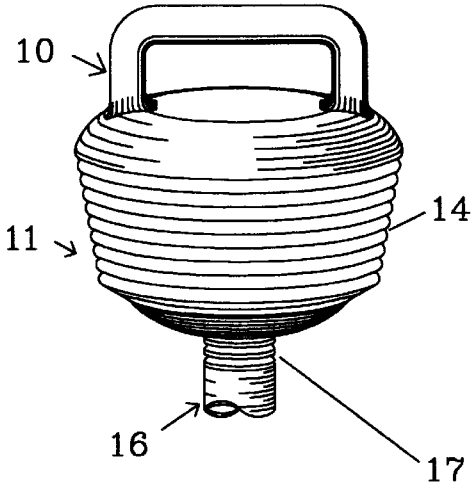
FIG. 2 is a schematic side elevation of the Bellows Pump for Clearing clogged Toilets and Drains showing the bellows portion of the device with handle in the compressed state.

FIG. 2 depicts the bellows 11 in the collapsed position with the transverse pleats 14 resting against each other in a nested position.

Figure 3:
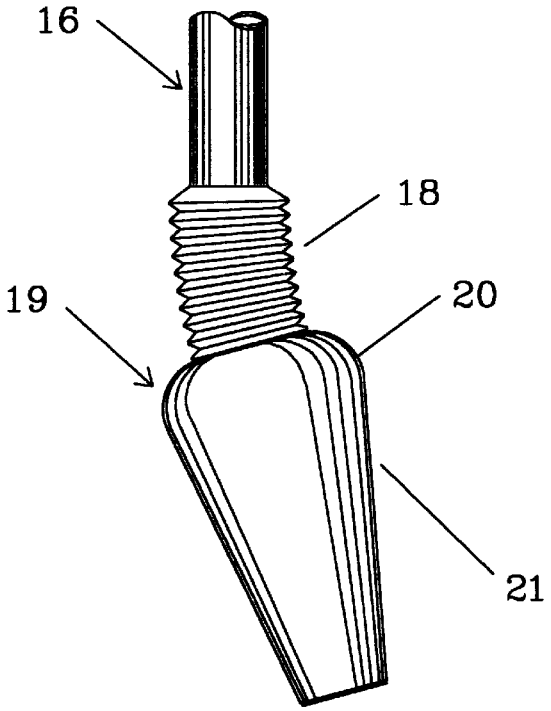
FIG. 3 is a schematic side elevation of the Bellows Pump for Clearing Clogged Toilets and Drains showing the conical shaped adapter bent at the pleated annular joints of the cylindrical tube.

FIG. 3 depicts the flexibility of the pleated annular joints 18 on the cylindrical tube 16.

Figure 4:
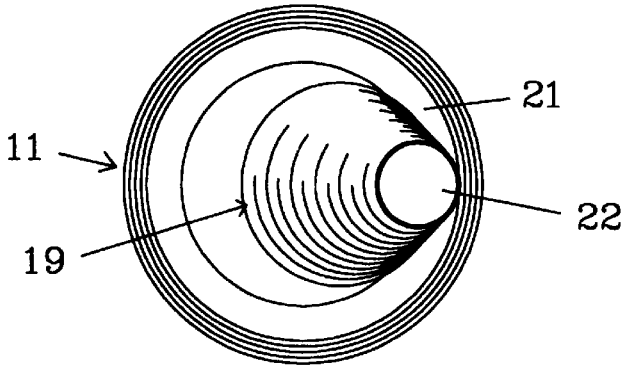
FIG. 4 is a schematic bottom elevation of the Bellows Pump for Clearing Toilets and Drains showing the circular tip of the conical shaped adapter.

FIG. 4 depicts a bottom schematic view of the device showing the adapter tip outlet 22, the cone portion 21, the elongated conical shaped adapter 19, and the bottom of the bellows 11.

Preferred Embodiment—Operation

In operation, the user simply inserts the elongated conical shaped adapter 19 into the toilet outlet or drain, effectively making a seal between the device and the drain outlet. Pushing down on the device's handle 10 collapses the bellows 11, thereby forcing a blast of air from the bellows 11 through the flexible cylindrical tube 16 and conical shaped adapter 19 out the adapter outlet tip 22 into the drain outlet, unclogging the stoppage. When the handle is released the bellows return to their relaxed or open position ready to be compressed again. The user may control the volume of air by controlling the amount of and frequency of collapse of the bellows 11.

The user, as an alternative method of operation, may place the device into the water with the bellows already collapsed FIG.2, and by releasing the bellows 11, draw water into the device through the adapter tip 22. When the elongated flexible conical adapter 19 is then inserted in the drain outlet effecting a seal, and the handle 10 is pushed downward collapsing the bellows 11, a combined burst of water and air is forced through the adapter cone 19 into the drain outlet, to clear the blockage.

CONCLUSIONS

Accordingly, the reader can see that the Bellows Pump for clearing clogged toilets and drains because of its design criteria can be used easily and effectively in a variety of sizes and shapes of toilet drains and outlets to clear blockages. It can be made of plastic or rubber and can be produced economically using the Blow Mold process. In addition, the simplicity of its design adds to its ease of use as well as its reliability and durability.

What is claimed is:

1. A bellows operated drain clearing device for unblocking clogged toilets or drains, comprising:

(a) a resilient, flexible, collapsible, and multi-pleated cylindrical bellows having a closed top, a threaded bottom end, a handle on its top, a diameter decreasing from its top to its bottom, a central aperture extending from the top vertically throughout, and the pleats of said bellows being generally transverse to the vertical and their outer edges or peripheries are angled;

(b) a cylindrical tube having pleated annular type joints to provide flexibility, a bottom end and a threaded top end connecting to said bottom end of the bellows; and (c) an elongated conical shaped adapter having its top connecting to the said bottom end of the cylindrical tube and being formed as a top or cap which is harder and denser than the remainder of the adapter, a resilient and flexible outer surface for sealing and conformity, a central aperture extending throughout its length and a round bottom outlet opening.

2. The device of claim 1 wherein the handle and bellows are unitary.

3. The device of claim 1 wherein the cylindrical tube and the elongated conical shaped adapter are unitary and the bellows with handle is secured thereto by the use of threads.

4. The device of claim 1 wherein said bellows, cylindrical tube and elongated conical shaped adapter are comprised of rubber or plastic.

5. The device of claim 1 wherein the decrease in diameter from top to bottom of said bellows increases its leverage for collapsibility.

6. The device of claim 1 wherein the wall thickness of said pleats is substantially uniform.

7. The device of claim 1 wherein the pleated annular joints of said cylindrical tube provide some degree of flexibility but maintain its overall strength and rigidity.

8. The device of claim 1 wherein the bellows, when collapsed against the top of the cylindrical tube into a nesting area, is automatically returned to its original shape and position when released.

9. The device of claim 1 wherein the conical shaped adapter is elongated, resilient and flexible allowing it to conform to, and make an effective seal in various size and shaped toilet outlets and drains and return to its original shape when removed therefrom.

* * * * *